US006548013B2

(12) United States Patent
Kadavy et al.

(10) Patent No.: US 6,548,013 B2
(45) Date of Patent: Apr. 15, 2003

(54) PROCESSING OF PARTICULATE NI-TI ALLOY TO ACHIEVE DESIRED SHAPE AND PROPERTIES

(75) Inventors: Thomas D. Kadavy, Bellevue, WA (US); Donald C. Baumgarten, Seattle, WA (US)

(73) Assignee: SciMed Life Systems, Inc., Maple Grove, MN (US)

( * ) Notice: Subject to any disclaimer, the term of this patent is extended or adjusted under 35 U.S.C. 154(b) by 0 days.

(21) Appl. No.: 09/768,643

(22) Filed: Jan. 24, 2001

(65) Prior Publication Data

US 2002/0098105 A1 Jul. 25, 2002

(51) Int. Cl.[7] ..... B22F 3/24
(52) U.S. Cl. ..... 419/28; 419/36; 419/37
(58) Field of Search ..... 419/36, 37, 28

(56) References Cited

U.S. PATENT DOCUMENTS

| | | | | |
|---|---|---|---|---|
| 2,852,366 | A | 9/1958 | Jenkins | 75/201 |
| 3,174,851 | A | 3/1965 | Buehler et al. | 75/170 |
| 3,465,430 | A | 9/1969 | Barber et al. | 29/599 |
| 3,523,354 | A | 8/1970 | Loewenstein | 29/423 |
| 3,529,958 | A | 9/1970 | Buehler | 75/135 |
| 3,535,093 | A | 10/1970 | Sara | 29/182.2 |
| 3,594,239 | A | 7/1971 | Wang | 148/13 |
| 3,652,969 | A | 3/1972 | Willson et al. | 337/140 |
| 3,708,282 | A | 1/1973 | Burr et al. | 75/200 |
| 3,953,253 | A | 4/1976 | Clark | 148/131 |
| 3,985,177 | A | 10/1976 | Buehler | 164/51 |
| 4,144,057 | A | 3/1979 | Melton et al. | 75/134 C |
| 4,149,911 | A | 4/1979 | Clabburn | 148/11.5 R |
| 4,198,081 | A | 4/1980 | Harrison et al. | 285/381 |
| 4,205,293 | A | 5/1980 | Melton et al. | 337/140 |
| 4,279,121 | A | 7/1981 | Ryan et al. | 57/258 |
| 4,304,613 | A | 12/1981 | Wang et al. | 148/11.5 N |

(List continued on next page.)

FOREIGN PATENT DOCUMENTS

| | | | |
|---|---|---|---|
| JP | 60-174804 | * | 9/1985 |
| JP | 2-17290 | * | 1/1990 |

OTHER PUBLICATIONS

Kyogoku, H. et al; Fabrication of TiNi shape memory alloy by powder injection molding, Funtai oyobi Funmatsu Yakin (1999), 46(10), Abstract.*

Kataoka, Y. et al.; Development of shape memory alloy by combustion sysnthesis and metal injection molding process, Aichi–ken Kygyo Gijutsu Senta Kenkyu Hokoku (2000), Abstract.*

Internet Article: "Introduction to Shape Memory and Superelasticity" 2 sheets.

Internet Article: "Making Shape Memory Springs," 2 sheets.

Internet Article: "Memry Frequently Asked Questions," 6 sheets.

(List continued on next page.)

*Primary Examiner*—Ngoclan Mai
(74) *Attorney, Agent, or Firm*—Fish & Richardson P.C.

(57) ABSTRACT

A method for manufacturing complex shape memory alloy materials is described. The method comprises generating a particulate form of a shape memory alloy, combining the particulate with a binder, molding, heating (which may include the steps of debinding and sintering), and thermomechanical processing. The method allows for the formation of complex shape memory alloy materials that exhibit the desirable properties of shape memory alloys, namely shape memory and superelasticity.

47 Claims, 1 Drawing Sheet

U.S. PATENT DOCUMENTS

| | | | | | |
|---|---|---|---|---|---|
| 4,310,354 | A | | 1/1982 | Fountain et al. | 75/211 |
| 4,368,074 | A | | 1/1983 | Otto, Jr. et al. | 419/51 |
| 4,386,971 | A | | 6/1983 | Melton et al. | 148/11.5 R |
| 4,404,025 | A | | 9/1983 | Mercier et al. | 148/11.5 F |
| 4,411,712 | A | | 10/1983 | Marancik | 148/11.5 Q |
| 4,412,872 | A | | 11/1983 | Albrecht et al. | 148/11.5 F |
| 4,423,119 | A | | 12/1983 | Brown et al. | 428/558 |
| 4,568,516 | A | | 2/1986 | Adlerborn et al. | 419/26 |
| 4,654,092 | A | | 3/1987 | Melton | 148/402 |
| 4,657,822 | A | | 4/1987 | Goldstein | 428/552 |
| 4,710,348 | A | | 12/1987 | Brupbacher et al. | 420/129 |
| 4,719,077 | A | * | 1/1988 | Suzuki et al. | 419/23 |
| 4,737,332 | A | * | 4/1988 | Miyashita et al. | |
| 4,751,048 | A | | 6/1988 | Christodoulou et al. | 420/129 |
| 4,758,285 | A | | 7/1988 | Hodgson et al. | 148/11.5 R |
| 4,772,452 | A | | 9/1988 | Brupbacher et al. | 420/129 |
| 4,800,065 | A | | 1/1989 | Christodoulou et al. | 420/129 |
| 4,808,225 | A | * | 2/1989 | Donachie et al. | 75/246 |
| 4,808,372 | A | | 2/1989 | Koczak et al. | 420/457 |
| 4,830,262 | A | | 5/1989 | Ishibe | 228/156 |
| 4,915,908 | A | | 4/1990 | Nagle et al. | 420/590 |
| 4,916,030 | A | | 4/1990 | Christodoulou et al. | 428/614 |
| 4,917,964 | A | | 4/1990 | Moshier et al. | 428/614 |
| 4,925,445 | A | | 5/1990 | Sakamoto et al. | 604/95 |
| 4,985,202 | A | | 1/1991 | Moshier et al. | 420/590 |
| 5,047,182 | A | | 9/1991 | Sundback et al. | 264/28 |
| 5,258,155 | A | | 11/1993 | Sekido et al. | 264/109 |
| 5,332,537 | A | * | 7/1994 | Hens et al. | 264/22 |
| 5,723,083 | A | | 3/1998 | Bogan, Jr. et al. | 264/177.11 |
| 5,882,444 | A | | 3/1999 | Flomenblit et al. | 148/510 |
| 5,972,027 | A | * | 10/1999 | Johnson | 623/1 |

OTHER PUBLICATIONS

Internet Article: "Nitinol Devices & Components," 3 sheets.
Internet Article: Setting Shapes in NiTi,: 1 sheet.
Internet Article: "Shape Memory Alloys," 12 sheets.
Internet Article: "Shape–Memory Alloys Offer Untapped Potential," 6 sheets.
Internet Article: "Two–Way Memory," 2 sheets.

* cited by examiner

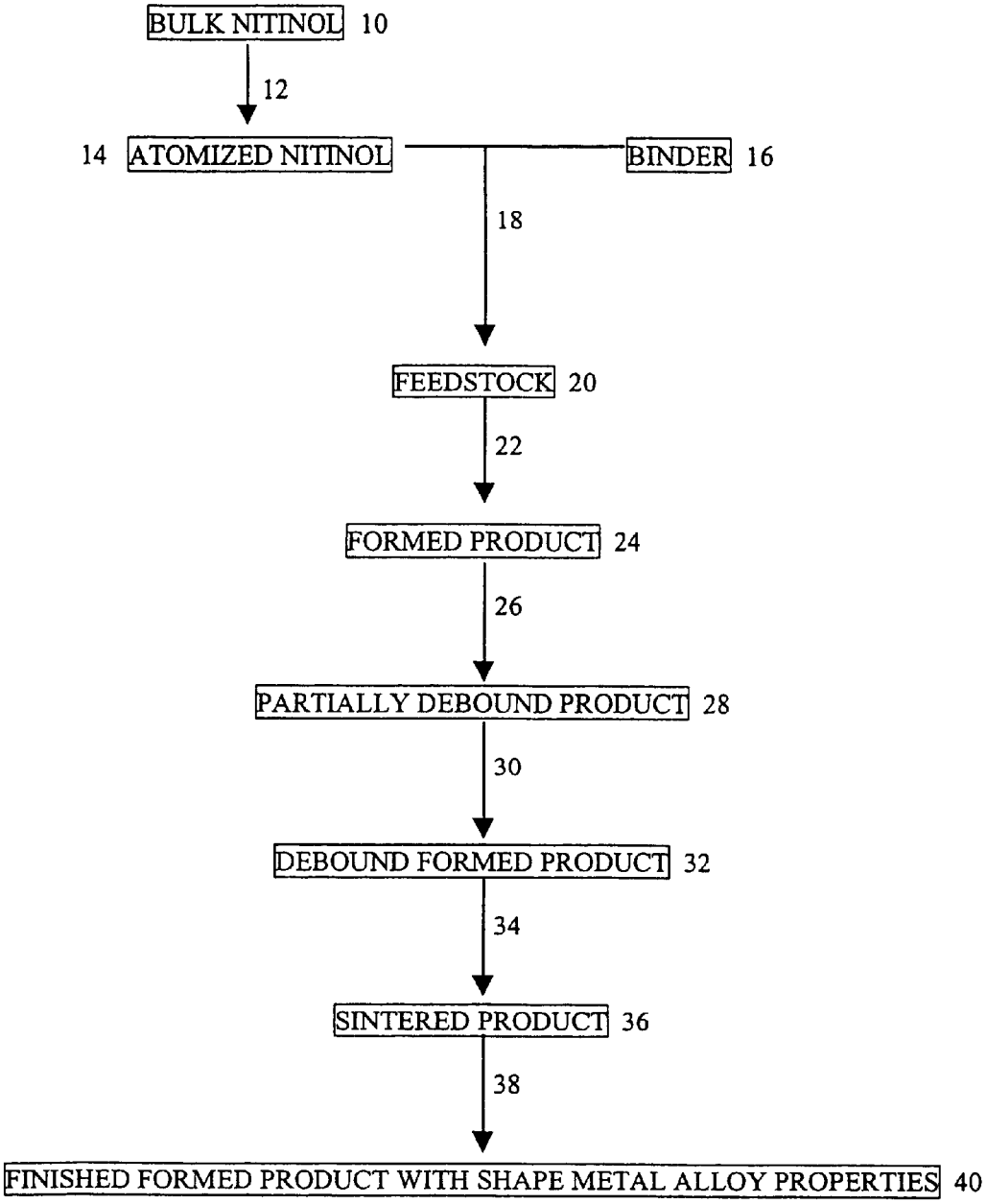
BULK NITINOL 10
12
14 ATOMIZED NITINOL
BINDER 16
18
FEEDSTOCK 20
22
FORMED PRODUCT 24
26
PARTIALLY DEBOUND PRODUCT 28
30
DEBOUND FORMED PRODUCT 32
34
SINTERED PRODUCT 36
38
FINISHED FORMED PRODUCT WITH SHAPE METAL ALLOY PROPERTIES 40

PROCESSING OF PARTICULATE NI-TI ALLOY TO ACHIEVE DESIRED SHAPE AND PROPERTIES

BACKGROUND OF THE INVENTION

1. Technical Field of the Invention

The present invention relates to a method for manufacturing products from shape memory alloys, particularly nickel-titanium (Ni—Ti) alloys such as nitinol, using injection-molding techniques. Moreover, the method relates to the molding of nitinol into complex shapes and imparting the desired properties of nitinol, namely shape memory and superelasticity.

2. Description of the Prior Art

Shape memory metal alloys are combinations of metals that possess the ability to return to a previously defined shape when subjected to an appropriate temperature. Although a wide variety of shape memory alloys exist, only those that can recover from a significant amount of strain, or those that generate significant force while changing shape are considered commercially valuable. Examples of such alloys include nickel-titanium alloys (Ni—Ti) such as nitinol and copper based alloys. In the medical device community nitinol has received a great deal of attention not only for its shape memory and superelastic properties but also its biocompatibility.

Nitinol has two temperature-dependent forms. The low temperature form is called martensite. The martensitic form of nitinol is characterized by a zigzag-like arrangement of microstructure referred to as "self-accommodating twins". Martensitic nitinol is soft and easily deformed into new shapes. When martensitic nitinol is exposed to higher temperatures, it undergoes a transformation (sometimes called the thermoelastic martensitic transformation) to its stronger, high temperature form called austenite. The austenite form of nitinol is less amenable to deformation.

The unique properties of shape memory alloys such as nitinol, particularly shape memory and superelasticity, are inherent based upon a phase transformation from a low temperature martensite form to the stronger, high temperature austenite. This transformation occurs not at a specific point, but rather over a range of temperatures. The key temperature points that define the transformation, beginning with the lowest temperature, are the martensitic finishing temperature ($M_f$), the martensitic starting temperature ($M_s$), the austenite starting temperature ($A_s$), and finally the austenite finishing temperature ($A_f$). At temperatures above $A_f$, nitinol possesses the desired properties of shape memory and superelasticity. Moreover, the transformation also exhibits hysteresis in that the transformations occurring upon heating and cooling do not overlap.

Shape memory is a unique property of shape memory alloys that enables a deformed martensitic form to revert to a previously defined shape with great force. An illustrative example of how shape memory properties work is a nitinol wire with its "memory" set as a tightly coiled, unexpanded spring. While in the martensitic form, the spring is easily expanded and if a constant force is applied to the spring, such as a weight pulling downward on a vertically placed spring, the spring expands. But, when the temperature of the spring is increased above the transformation temperature, the spring "remembers" its predefined state and returns to its uncoiled state. This can occur with significant force. For example, the force could be enough to lift the weight.

The mechanism of shape memory is based upon the crystal fragments or grains. When the memory is set, the grains assume a specific orientation. When martensitic nitinol is deformed, the grains assume an alternate orientation based upon the deformation. Shape memory takes place when deformed martensitic nitinol is heated above its transformation temperature so as to allow the grains to return to their previously defined orientation. When this occurs, the nitinol "remembers" its predefined state, based upon the grain orientation, and returns to its predefined state.

Superelasticity is a second unique property of shape memory alloys. This property is observed when the alloy is deformed at a temperature slightly above the transformational temperature and the alloy returns to the original orientation. An illustrative example of this effect is a nitinol wire wrapped around a cylindrical object, such as a mandrel. When nitinol exhibiting superelastic properties is coiled around a mandrel multiple times and then released, it will rapidly uncoil and assume its original shape. A non-superelastic nitinol wire would tend to yield and conform to the mandrel. Superelasticity is caused by the stress-induced formation of some martensite above its normal temperature. Therefore, when nitinol is deformed at these elevated temperatures, the martensite reverts to the undeformed austenite state when the stress is removed.

Manufacturing of molded metal or metal alloy products traditionally has been accomplished by casting, powder metallurgy, or powder injection molding techniques. Casting involves the melting of the metal or alloy and forming the product in a mold or die. Powder metallurgy generally involves the molding of particulate metal, often by using die and piston compaction. Powder injection molding is a refinement of powder metallurgy wherein atomized or particulate metals or alloys are molded by injection into a mold. Powder injection molding requires smaller particulate matter than other powder metallurgy techniques and generally results in parts that have greater density.

Traditional powder metallurgy techniques have generally not worked in the formation nitinol products. To better understand the reasons for this, the importance of crystal fragments, or grains, need to be further considered. Grains are the fundamental microscopic units of metal structures. The arrangement and size of grains can have a major impact on both the desirable properties of nitinol and the ability to thermo-mechanically process nitinol so as to impart the desirable properties. For example, when traditional powder metallurgy techniques are used on standard alloys, the result is grains of a random orientation. Nitinol with this grain configuration does not have shape memory or superelastic properties. In order to impart the desired properties, cold or hot working must occur so as to align the grains in a specific orientation amenable to thermo-mechanical processing.

Casting results in similar observations and, therefore, cast nitinol does not have shape memory or superelastic properties. Casting of nitinol also results in enlarged grains. In order to impart the desirable properties into cast nitinol, cold or hot working again needs to occur so as to align the grains in a conformation suitable for thermo-mechanical processing. When typical preparations of nitinol, such as wire, are manufactured, a cast nitinol product is used that is then drawn or rolled so as to appropriately align the grains. Using these techniques, which are well known in the art, nitinol wire can be readily produced.

Because working is required to impart shape memory and superelasticity into cast nitinol, the ability to form complex shapes using traditional casting techniques is limited. The manufacturing of finished parts from nitinol has generally been accomplished by starting with preshaped, semifinished nitinol in the form of a rod, tube, strip, sheet, or wire. The preshaped, semifinished nitinol can then be cold worked to produce the desired object. A novel method for manufacturing shape memory alloys, such as nitinol, into complex shapes while imparting the desired properties would prove beneficial.

In addition to the drawbacks related to grain structure, another difficulty associated with manufacturing formed nitinol parts is the high reactivity of nitinol with oxygen. Atomization of nitinol complicates this difficulty by increasing the surface area where oxidation can take place. When nitinol reacts with oxygen, its properties can vary greatly. Partially oxidized nitinol has a differing transformation temperature, different sintering requirements, and may lack shape memory or superelastic properties. Additionally, partially oxidized nitinol may become brittle and difficult to work. High oxygen reactivity has limited the use of traditional powder metallurgy techniques on nitinol.

In addition to oxygen, nitinol can readily react with nitrogen, carbon, and other elements. Similar to oxygen, introduction of even a small amount of impurities from these elements can cause a change in the properties of nitinol. The most significant effect is changing the range of the transformational temperature. This can have an effect on the utility of a product. Reactivity with oxygen or other elements limits the ability to manufacture complex nitinol shapes using traditional powder metallurgy techniques. Application of current powder metallurgy and casting methods to nitinol, therefore, limits the ability to manufacture nitinol parts with complex shapes and then impart the desirable properties. A novel method for the manufacturing of shape memory alloys, for example nitinol, into complex shapes while imparting the desirable properties would prove beneficial.

SUMMARY OF THE INVENTION

A preferred embodiment of the present invention comprises a method for manufacturing complex shapes from atomized or particulate shape memory alloys while imparting the desired properties of shape memory and superelasticity. An exemplary embodiment of the present invention includes the use of atomized nitinol to form complex formed nitinol materials that exhibit the desired shape memory and superelastic properties.

An embodiment of the current invention includes combining the atomized nitinol with a binder. The binder can help the atomized nitinol retain its shape after being removed from the mold and helps to reduce air pocket formation during molding. The binder comprises at least one substance including, but not limited to, wax, plastic, or surfactant. One skilled in the art would be familiar with developing an appropriate binder for use with most embodiments of the current invention. It is further conceivable that an embodiment of the current invention may include methods that do not include the use of a binder.

The mixture of atomized nitinol and binder, referred to as a feedstock, is used for injection molding in the preferred embodiment of the current invention. The feedstock is loaded into injection molding equipment and molded according to a protocol familiar to one skilled in the art.

In a preferred embodiment of the current invention, following molding, the newly formed material can be removed from the mold and subjected to at least one debinding step. During an early debinding step, some of the binder is removed, which open up pores for subsequent binder removal. In an exemplary embodiment of the current invention, an early debinding step may include solvent debinding.

After the end of early debinding, a second debinding step can occur in a preferred embodiment of the current invention. This late debinding step preferably includes heating or another debinding method known by one skilled in the art. Late debinding usually finishes the debinding process and results in the removal of some, most, or all of the binder components.

After debinding, in a preferred embodiment of the current invention, the process of sintering begins. Sintering, familiar to one skilled in the art, preferably includes the use of heat to close the pores within the formed material and increases the density the product. Sintering usually results in uniform shrinking of the formed product. One skilled in the art would be familiar with shrinking associated with sintering and would be capable of designing products while accounting for this shrinking.

In the preferred embodiment of the invention, after the formed product is sintered it can be subjected to thermo-mechanical processing. Thermo-mechanical processing includes mechanical working methods such as cold or hot working, and heat treatment. In an exemplary embodiment of the current invention, cold or hot working can occur in order to arrange the grain structure appropriately so as to make the formed part amenable to heat treatment. Most of the methods of hot and cold working known by those skilled in the art results in changing the shape of the area to be worked. For example, cold working nitinol wire by drawing results in transforming a shape with a relatively larger cross-sectional area to one with a relatively smaller cross-sectional area.

Heat treatment comprises the means for imparting the desired properties of shape memory and superelasticity into formed nitinol materials. Thermo-mechanical processing results in the appropriate alignment of grains within the microstructure of the part for imparting the desired properties. The preferred embodiment of the current invention includes heat treatment of a sintered, debound, formed product to impart desirable shape memory and superelastic properties. Alternate embodiments include heat treatment on products that may have omitted one or more of the steps prior to heat treatment. Additionally, in an exemplary embodiment of the invention heat treatment may be localized to a region of the formed product.

BRIEF DESCRIPTION OF THE DRAWINGS

FIG. 1 shows a schematic drawing demonstrating a preferred embodiment of the invention.

DETAILED DESCRIPTION OF THE PREFERRED EMBODIMENTS

FIG. 1 illustrates a schematic representation of the invention in a preferred embodiment. The starting material is preferably an atomized or particulate shape memory alloy. The shape memory alloy generally comprises more than one element including, but not limited to, nickel, titanium, copper, gold, aluminum, manganese, iron, platinum, cobalt, palladium, silicon, carbon, beryllium, tin, and gallium.

In an exemplary embodiment of the current invention the starting material comprises atomized Ni—Ti alloy (nitinol). Particulate shape memory alloys, including nitinol, can be generated by multiple methods. In the preferred embodiment of the invention the generation of particulate nitinol occurs by atomization 12. The process of atomization 12 consists of forcing molten nitinol through an orifice into a stream of high-velocity air, steam, or inert gas. The nitinol is separated into fine particles that rapidly lose heat and solidify. Methods of atomization are known by those skilled in the art and may include variations of the protocol described above. In alternate embodiments of the current invention particulate shape memory alloys can be produced by other methods known by those skilled in the art including gaseous reduction and electrolysis.

Atomization breaks down nitinol bar or bulk nitinol 10 into particulate or atomized nitinol 14. Atomized nitinol is understood to be a particulate form of nitinol that comprises a fine powdery substance that can be readily formed into a multiplicity of complex forms. Atomization can change the physical properties of nitinol by substantially increasing surface area and reducing the absolute amount of energy required to change the ambient temperature of a given individual piece.

By increasing the surface area, atomization can increase the probability of nitinol reacting with oxygen. When oxygen reacts with nitinol, the result can be changes in properties. These changes may include changes in transformation temperatures, changes in strength, and loss of ability to impart the desirable shape memory and superelastic properties. Atomized nitinol, therefore, is preferably maintained in a vacuum or in an atmosphere of one or more inert gases. For example, atomized nitinol can be purchased in closed glass containers under an inert atmosphere. Multiple forms of stock bulk nitinol are available commercially including wire of varying finishes (including as-drawn finish, polished, black oxide, and sandblasted), bar, rod, strip, sheet, and tubing.

The atomized nitinol powder 14 is preferably combined with a binder 16 through a physical means 18 including mixing, kneading, or stirring. The physical means of mixing atomized nitinol powder 14 with a binder 16 could take place in containers either connected to or not connected to the injection molding machinery. In alternative embodiments of the current invention, the binder may be mixed with the feedstock through an alternate means. The binder 16 comprises at least one substance including but not limited to plastics, waxes, and surfactants. The binder 16 can serve the purpose of assisting atomized nitinol 14 to retain its molded shape after injection molding 22 and minimizing air pocket formation during the molding process. The binder 16 can take on a multiplicity of formulations that can be tailored to a specific part. In general, the binder formulation may differ based upon the size of the formed part, the composition of the alloy, and the temperature required for debinding or sintering. One skilled in the art would be familiar with the process of developing a specific binder suitable for a particular embodiment of the current invention. Once combined with the binder, nitinol is less likely to react with oxygen. At this point, manufacturing may take place at more standard conditions.

The combined atomized nitinol and binder, hereafter referred to as the feedstock 20, is formed into the desired shape by injection molding 22. In this process, the feedstock 20 is formed by mixing the powder along with the binder, and then loaded into the injection-molding equipment. In an embodiment of the current invention, the feedstock 20 can be loaded into a hopper of the injection molding equipment and then injected into a mold at a multiplicity of pressure ranges that depend upon the equipment and method used. One skilled in the art would be familiar with the equipment used for and the process of injection molding suitable for any embodiment of the current invention.

In the preferred embodiment of the current invention, the mold is cooled or allowed sufficient time for the temperature to fall below the freezing point of the binder and the result is a solidified formed product 24 composed of particulate nitinol and binder. In an embodiment of the current invention, the injection molding equipment may be associated with a means for cooling formed materials. This embodiment may speed up the process of freezing or allow for greater control over the freezing process. The formed product 24 can then be removed from the mold and should retain its form. An alternate embodiment of the current invention can be conceived in which the steps that follow molding may take place while the formed product still remains in the mold.

In the preferred embodiment of the invention, the next step after molding the feedstock 20 into the formed product 24 is debinding. Debinding generally comprises an initial debinding step 26 such as solvent debinding. The initial debinding step may alternatively include one or more heating steps. In the preferred embodiment of the invention, debinding takes place after the formed product is removed from the injection molding equipment. Alternatively, debinding could begin or take place while the formed product is still contained within the molding equipment. Solvent debinding includes the treatment of the formed product with an appropriate solvent capable of dissolving at least one of the binder 16 components. This or another initial debinding step 26 is important since it can open small pores within the structure of the part that can allow the remaining binder to be removed without impact on the final structure.

Debinding of the partially debound product 28, in the preferred embodiment of the current invention, usually continues by moving the part to an oven or furnace for final debinding 30. While preferably in a oven, the remaining binder components can be removed by evaporation or another means. The specific temperatures required for debinding would depend upon the composition of the binder. This final debinding step 30 yields the debound formed product 32. It is further conceivable that in an additional embodiment of the current invention the final debinding step may or may not involve the use of heat. Further, the final debinding step may involve additional physical separation means including but not limited to solvent debinding, grinding, drilling, and scraping. In a further embodiment of the current invention, final debinding may not be required. In this embodiment, it would be assumed that initial debinding may be sufficient to remove the appropriate amount of binder or that removal of a major proportion of the binder is not required for the production of the final formed product.

Further heating of the debound formed product 32 begins the process of sintering 34 wherein the pores of the debound formed product 32 begin to seal. In one embodiment of the current invention, sintering may actually begin during a debinding step. Sintering conditions can vary and often control several physical properties of the finished part including hardness, grain size, and texture. Sintering generally comprises at least one step of heating over at least one temperature.

Sintering generally occurs in a high vacuum since oxidation readily takes place at typical sintering temperatures. Avoiding oxidation during sintering would be considered advantageous since oxidation would introduce impurities into the formed product. Impurities may causes changes in the physical properties of the sintered product including loss of shape memory, changes in transformational hysteresis, and changes in strength.

Often, greater than or equal to about 98 percent density can be achieved by sintering which implies that very few pores remain in the finished product. Uniform shrinking generally takes place during sintering that may reduce the final size of the product. This relative amount of shrinking may vary with the mass or composition of the final part but typically is constant and uniform. The result of sintering 34 the debound formed product 32 is the sintered product 36.

Similar to cast nitinol, sintered nitinol lacks the desirable properties of shape memory and superelasticity. In the case of cast nitinol, the grain structure is altered such that imparting the desirable properties into nitinol may not be easily accomplished. For example, the grains may be enlarged and oriented in a random configuration. When the grains are in this condition they must first be subject to a significant amount of cold or hot working so as to set the appropriate grain structure. The cold or hot working traditionally has taken the form of rolling, drawing, or a similar method.

In the preferred embodiment of the current invention, thermo-mechanical processing 38 can follow sintering 34. Thermo-mechanical processing 38 includes mechanical processing such as cold or hot working, and heat treatment. Multiple methods of cold and hot working metal are known in the prior art. Mechanical shaping at temperatures that produce strain hardening is known as cold working. Methods of cold working that may be included in an embodiment of the current invention include, but are not limited to, mechanical shaping, drawing, rolling, hammering, and deforming. Any of these methods or additional cold working methods could be applied to the current invention. Mechanical shaping at temperatures that do not produce strain hardening is known as hot working.

Because multiple metals or metal alloys can be subjected to hot or cold working, and because each starting material may have unique physical properties, hot and cold working does not generally take place at a particular temperature. Although mechanical working is considered an embodiment of the current invention, it may not be required to achieve the desired effect. Therefore, an additional embodiment of the current invention may include thermo-mechanical processing that does not include hot or cold working.

In the preferred embodiment of the current invention, after the desired amount of mechanical working, heat treatment takes place. Heat treatment involves heating the product to a specific temperature for a specific amount of time so as to set the grain structure and, more importantly, set the "memory" function of the shape memory alloy. Heat treatment is commonly used in the prior art for the purpose of adding additional strength to a manufactured product. Heat treatment offers no utility for improving strength in pure metals. This is because heat treatment enables differently sized atoms to be dispersed through the crystal structure in a manner appropriate for enabling optimal structure for strength. In the context of shape memory alloys, heat treatment enables appropriate arrangement of grains within the crystal structure of the alloy that serve as the "memory".

Additionally, thermo-mechanical processing can be limited to a localized area of the part. Heat treating of a specific region of a formed part may include using heating devices such as lasers, or by using typical methods of heat treatment from the prior art or modifications thereof Localized heat treatment may enable one skilled in the art to impart the desired properties of nitinol into larger, more complicated shaped regions of a formed product. Therefore, multiple embodiments of invention can be conceived that may include multiple means of localized heat treatment onto one or more regions of the sintered product. After thermo-mechanical processing is complete, the result is the finished formed product with shape memory alloy properties 40.

In general, cold and hot working can change the size and shape of the finished product. Therefore, an exemplary embodiment of the current invention would include molding a formed product that is undersized or oversized within the local region to be subjected to heat treatment. Because some level of cold or hot working would preferably occur so that heat treatment can impart the desirable properties of nitinol, it would be advantageous to appropriately alter the size of the formed product within the local area of interest.

Numerous advantages of the invention covered by this document have been set forth in the foregoing description. It will be understood, however, that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A method for manufacturing products from shape memory alloys comprising:

generating a particulate form of at least one shape memory alloy;

combining the particulate shape memory alloy with a binder to form a feedstock;

molding the feedstock into a desired shape to produce a formed product;

at least partially debinding the formed product to produce a debound formed product;

heating the at least partially debound formed product to produce a sintered product; and thermo-mechanical processing the sintered product.

2. The method of claim 1, wherein the step of generating a particulate form of at least one shape memory alloy includes atomization.

3. The method of claim 1, wherein the shape memory alloy includes nickel.

4. The method of claim 1, wherein the shape memory alloy includes titanium.

5. The method of claim 1, wherein the shape memory alloy includes copper.

6. The method of claim 1, wherein the shape memory alloy includes gold.

7. The method of claim 1, wherein the shape memory alloy includes aluminum.

8. The method of claim 1, wherein the shape memory alloy includes manganese.

9. The method of claim 1, wherein the shape memory alloy includes iron.

10. The method of claim 1, wherein the shape memory alloy includes platinum.

11. The method of claim 1, wherein the shape memory alloy includes cobalt.

12. The method of claim 1, wherein the shape memory alloy includes palladium.

13. The method of claim 1, wherein the shape memory alloy includes silicon.

14. The method of claim 1, wherein the shape memory alloy includes carbon.

15. The method of claim 1, wherein the shape memory alloy includes beryllium.

16. The method of claim 1, wherein the shape memory alloy includes tin.

17. The method of claim 1, wherein the shape memory alloy includes gallium.

18. The method of claim 1, wherein the step of molding the feedstock into the desired shape includes injection molding.

19. The method of claim 1, wherein the binder includes wax.

20. The method of claim 1, wherein the binder includes plastic.

21. The method of claim 1, wherein the binder includes surfactant.

22. The method of claim 1, wherein the step of debinding the formed product includes solvent debinding.

23. The method of claim 1, wherein the step of debinding the formed product further comprises heating.

24. The method of claim 1, wherein the step of heating further comprises sintering.

25. The method of claim 1, wherein the step of thermo-mechanical processing further comprises cold working.

26. The method of claim 1, wherein the step of thermo-mechanical processing further comprises hot working.

27. The method of claim 1, wherein the step of thermo-mechanical processing further comprises drawing.

28. The method of claim 1, wherein the step of thermo-mechanical processing further comprises rolling.

29. The method of claim 1, wherein the step of thermo-mechanical processing further comprises heat treating.

30. The method of claim 1, wherein thermo-mechanical processing can be limited to a local region of the formed product.

31. A method for manufacturing complex shapes from nitinol comprising the steps of:

combining particulate nitinol with a binder to form a feedstock;

molding the feedstock into a desired shape;

debinding;

heating; and thermo-mechanical processing.

32. The method of claim 31, wherein the step of molding the feedstock into the desired shape includes injection molding.

33. The method of claim 31, wherein the binder includes wax.

34. The method of claim 31, wherein the binder includes plastic.

35. The method of claim 31, wherein the binder includes surfactant.

36. The method of claim 31, wherein the step of debinding includes solvent debinding.

37. The method of claim 31, wherein the step of debinding further comprises heating.

38. The method of claim 31, wherein the step of heating further comprises sintering.

39. The method of claim 31, wherein the step of thermo-mechanical processing further comprises cold working.

40. The method of claim 31, wherein the step of thermo-mechanical processing further comprises hot working.

41. The method of claim 31, wherein the step of thermo-mechanical processing further comprises drawing.

42. The method of claim 31, wherein the step of thermo-mechanical processing further comprises rolling.

43. The method of claim 31, wherein the step of thermo-mechanical processing further comprises heat treating.

44. The method of claim 31, wherein thermo-mechanical processing can be limited to a local region of the formed product.

45. A method for manufacturing three-dimensional medical devices from shape memory alloys comprising the steps of:

providing a particulate form of nickel-titanium alloy;

combining the particulate nickel-titanium alloy with a binder to form a feedstock;

injection molding the feedstock into a desired shape to produce a formed product;

debinding the formed product in one or more steps to produce the debound product, wherein at least one debinding step includes solvent debinding;

heating the debound formed product to produce a sintered product; and thermo-mechanical processing the sintered product.

46. A method for manufacturing three-dimensional medical devices from shape memory alloys comprising the steps of:

providing a particulate form of nickel-titanium alloy;

combining the particulate nickel-titanium alloy with a binder to form a feedstock;

injection molding the feedstock into a desired shape to produce a formed product;

subjecting the formed product to a first debinding agent;

subjecting the formed product to a second debinding agent;

wherein the steps of subjecting the formed product to a first debinding agent and subjecting the formed product to a second debinding agent result in the production of the debound product;

heating the debound product to produce a sintered product; and thermo-mechanical processing the sintered product.

47. A method for manufacturing three-dimensional medical devices from shape memory alloys comprising the steps of:

providing atomized nickel-titanium alloy;

combining the atomized nickel-titanium alloy with a binder to form a feedstock;

injection molding the feedstock into a desired shape to produce a formed product;

solvent debinding the formed product;

heat debinding the formed product;

wherein the steps of solvent debinding and heat debinding produce the debound product;

sintering the debound formed product to produce a sintered product; and thermo-mechanical processing the sintered product.

* * * * *